United States Patent [19]

Osamu et al.

[11] 4,010,524

[45] Mar. 8, 1977

[54] APPARATUS FOR MANUFACTURE OF CONTINUOUS HINGE

[76] Inventors: Akashi Osamu, No. 6-22, 5-chome, Momodani, Ikuno, Osaka; Nakamura Masazo, No. 50, Taihoji-machi-higashino-cho, Minami, Osaka, both of Japan

[22] Filed: Nov. 6, 1975

[21] Appl. No.: 629,373

[52] U.S. Cl. ..... 29/11; 29/564.2; 29/33 S; 29/411; 29/416; 29/434; 29/437; 29/439

[51] Int. Cl.² ..... B21D 53/40; B21K 13/02

[58] Field of Search ..... 29/11, 411, 416, 417, 29/33 K, 33 S, 33 Q, 509, 200 B, 208 D, 437, 434, 439, 440; 16/168, 169

[56] References Cited

UNITED STATES PATENTS

| | | | |
|---|---|---|---|
| 442,656 | 12/1890 | Whittlesey | 29/11 |
| 611,714 | 10/1898 | Smith et al. | 29/11 |
| 1,604,228 | 10/1926 | Kellogg | 29/11 |
| 1,604,229 | 10/1926 | Kellogg | 29/11 |

FOREIGN PATENTS OR APPLICATIONS

| | | | |
|---|---|---|---|
| 1,167,782 | 4/1964 | Germany | 29/11 |

*Primary Examiner*—Victor A. DiPalma
*Attorney, Agent, or Firm*—George B. Oujevolk

[57] ABSTRACT

There is disclosed a manufacture of a continuous hinge. The process is as follows. A metal strip is fed intermittently by a predetermined length towards a press-machining station where the strip is simultaneously cut and bent to form a hole, flap, swaged flap and loop during the stoppage of the strip. The strip having loops is cut into predetermined length to form leaves for a hinge. A pair of leaves are assembled by inserting a pintle through the aligned loops, and the assembly is reformed by roll means.

1 Claim, 7 Drawing Figures

1
2
3
4
5
6
7
8
10
11
12
13
14
15
16
17
18
19
20
21
22
23
24
25
26
27
28
29
30
31
32
33
A
d

APPARATUS FOR MANUFACTURE OF CONTINUOUS HINGE

The present invention relates to a manufacture of a continuous hinge.

Conventionally, a long hinge used for a piano and similar devices is manufactured by the following separate processes: cutting a single metal plate into strips; press-machining the strips into hinge leaves by forming loops or knuckles, holes etc.; assembling a pair of leaves by alternately adjoining the knuckles of one leaf to those of the other; and inserting a pintle through the aligned knuckles and constricting the knuckles. As apparent, these complicated processes require much labour and time, resulting in higher production cost and lower productivity as well as lower precision of the products.

An object of the present invention is to obviate the above defects, and to provide a highly efficient process for producing leaves for a continuous hinge.

Another object of the invention is to provide an automatic process for producing a continuous hinge.

Further object of the invention is to provide a process making it possible to obtain a high precision continuous hinge.

Still further object of the invention is to provide an apparatus enabling automatic production of a continuous hinge.

Other objects and features of the invention will be apparent from the following description of the invention in reference to the accompanying drawings, in which.

Throughout the drawings, similar parts and elements are shown by the similar reference numerals and letters.

Figures 1, 2, 3:
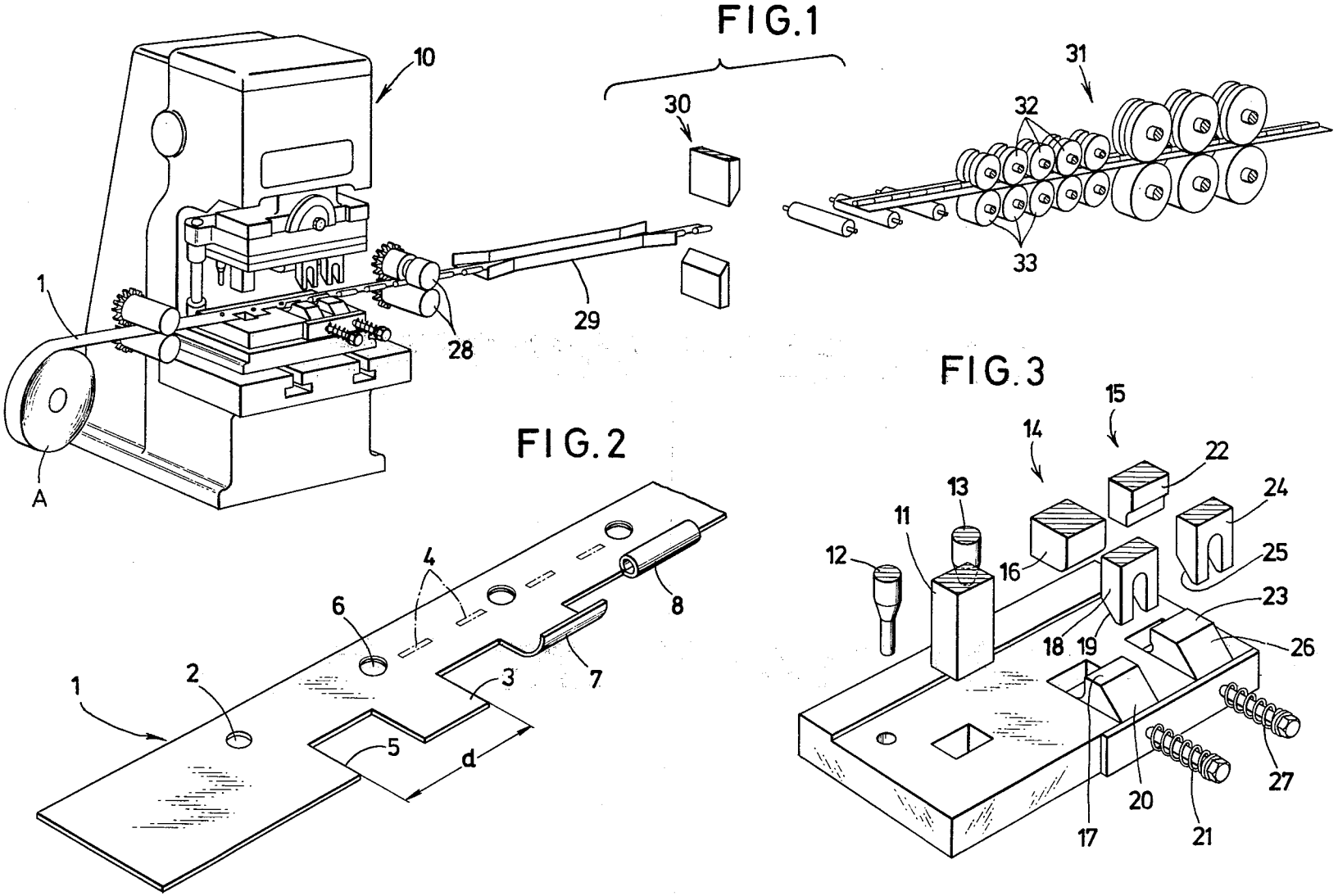
FIG. 1 is a diametrical perspective view showing the process of the invention.
FIG. 2 is a fragmentary perspective view showing a metal strip machined at a press-machining station.
FIG. 3 is a fragmentary perspective view of a set of dies for machining a strip.

Referring now to FIGS. 1 through 3, a metal strip 1 from a coil A is intermittently fed towards a press-machining station 10 at which the strip 1 is cut to provide a hole 2 and flap 3, the latter of which is swaged and looped during step-by-step advancement of the strip 1. The cutting, swaging, looping and other machining operations are simultaneously performed by a plurality of dies including cutting die 11, boring die 12, plane-off die 13, swaging die 14, and looping die 15. If desired, an impress die can be incorporated for impresses 4. These dies are arranged at the same spaces as those between the hole 2, notch 5, planed-off hole 6, swaged flap 7, and loop or knuckle 8. The strip 1 is adapted to advance a distance *d* at a time after the simultaneous operation of the dies 11 through 15. Therefore when the preceding flap is swaged by the die 14, the strip 1 is cut to be provided with a succeeding flap. Similarly when the swaged flap 7 is looped at the die 15, the flap 3 is swaged at the die 14. As will be understood, there may be mounted twice or more set of dies in order to improve productivity.

Figure 4:
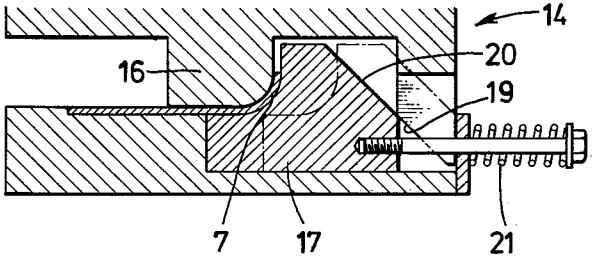

As shown in FIGS. 3 and 4, the swaging die 14 comprises an elevatable male die 16 with its inner edge curved, a slidable female die 17 with inwardly curved portion fittable to said curved edge of the male die 16, an elevatable actuator 18 having at the lower end a slant 19 engageable with a slant 20 provided on the female die 17, and a spring 21 urging the female die 17 away from the male die 16. The downward push of the actuator 18 causes the female die 17 to move towards the male die 16 by the slidable abutment of the slant 19 against the slant 20. Since the male die 16 abuts the upper face of the flap 3 of the strip 1, the outer end portion of the flap 3 is swaged along the curved edge of the male die by the press of the inwardly curved portion of the female die 17, as shown in FIG. 4.

Figure 5:
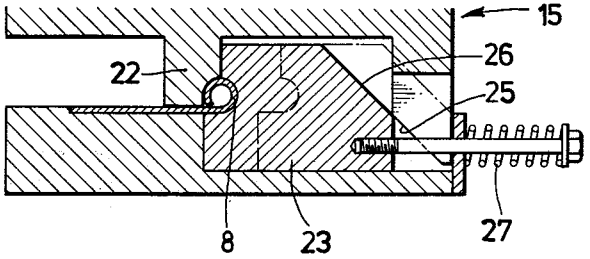
FIGS. 4 and 5 are sectional views showing the operations of swaging and looping dies.

The arrangement and operation of the looping die 15 are substantially similar to the swaging die 14. The die 15 includes an elevatable male die 22 having an inwardly curved corner substantially semi-circular in section, a slidable female die 23 having a substantially semi-circular depression, an elevatable actuator 24 having at the lower end a slant 25 engageable with a slant 26 on the female die 23, and a spring 27 urging the female die 23 away from the male die 22. The inwardly curved corner of the male die 22 and the depression of the female die 23 press the swaged flap 7 to form the loop 8 when matched together, as shown in FIG. 5.

The strip 1 thus formed with the loops or knuckles at one side runs through rolls 28 along opposed guides 29, and is cut at a cutting station 30 into a predetermined length to form leaves for a hinge. A pair of such leaves are assembled by inserting a pintle through the aligned knuckles. The assembly is then reformed and finished at a finishing station 31 including a plurality of opposed pairs of upper grooved rolls 32 and lower rolls 33. Thus the continuous hinge is completed.

Figure 6:
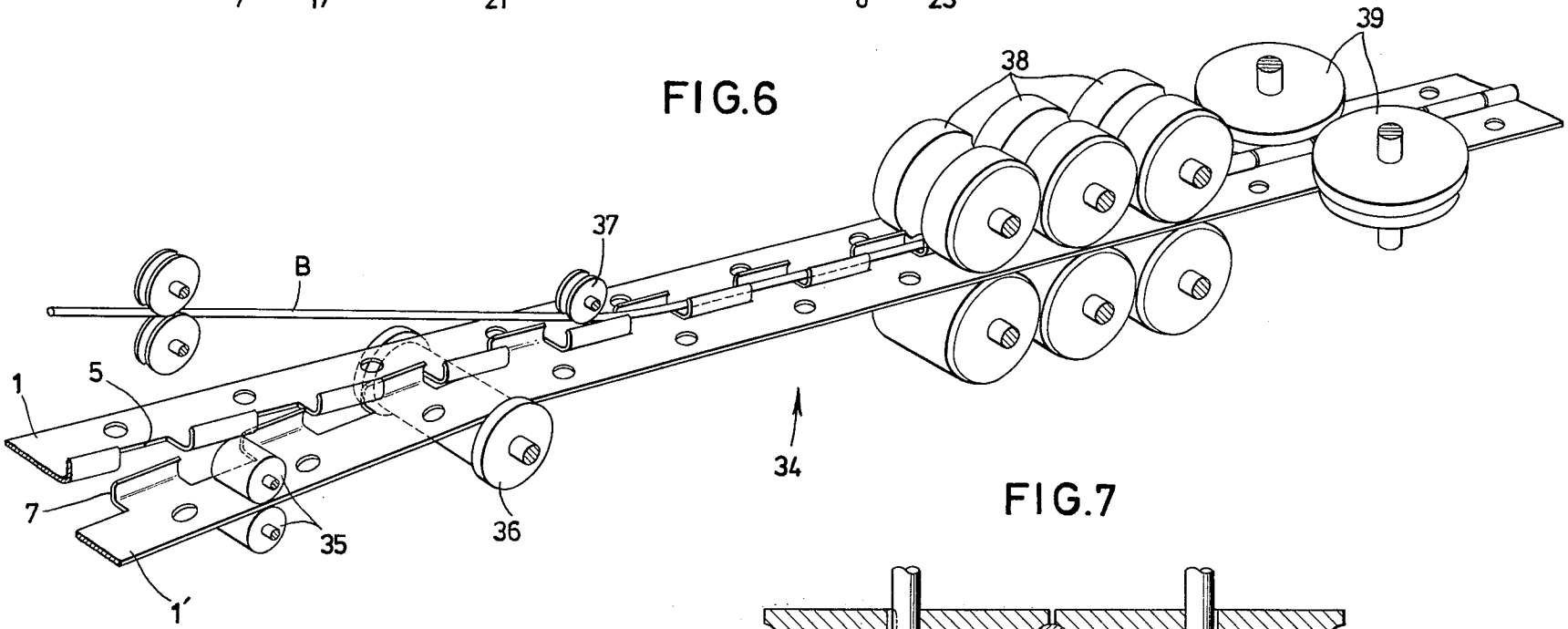
FIG. 6 is a diametrical perspective view illustrating a continuous hinge forming process.

In the above operations, assembling the leaves and inserting the pintle are performed by so-called off-line operation. FIG. 6 shows the improvement in this respect.

Instead of the cutting station 30, an automatic assembly station 34 is inserted in line with the press-machining station 10 and the finishing station 31. Also the press-machining station 10 is slightly modified so that the looping die 15 is eliminated. A pair of such modified press-machining stations are arranged in parallel.

Figure 7:
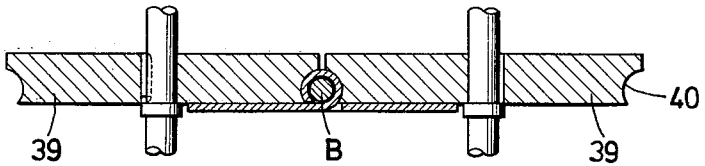
FIG. 7 is a sectional view showing rolls for reforming a knuckle.

Two lines of metal strips 1 and 1′ are cut, bored and swaged at the parallel press-machining stations. The strips 1, 1′ having the swaged flaps are fed towards the assembly station 34, so that the swaged flaps 7 of one of the strips fit in the notches 5 of the other, as shown in FIG. 6. This will be easily done when one of the strips is fed in an overlapping manner on the other at the portions of the flaps by means of rolls 35. As the strips 1, 1′ travel towards a guide roll 36 having a flange at each end thereof, they gradually join together whereby the swaged flaps form a channel-like path at the center of the engaged strips. At the position a wire B serving as a pintle is supplied in the channel-like path by means of a roll 37. Then the assembled strips with the wire B inserted run along grooved rolls 38 for the constriction of the swaged flaps, thereby forming knuckles about the wire B. If desired, laterally opposed rolls 39 for reforming the knuckles are arranged, succeeding the rolls 38. Each of the rolls 39 has an annular depression 40 of substantially semi-circular in section, as shown in FIG. 7.

The hinge assembly then continues towards the finishing station 31 of FIG. 1. Of course, said reforming rolls 39 can also be incorporated in the finishing station 31. Further the rolls 38, 39 and 32 can be continuously arranged to be an associated station of assembling and finishing.

As described above, according to the present invention, since the metal strip is machined into a continuous hinge wholly automatically without manual labour, a high precision continuous hinge can be obtained with high efficiency.

We claim:

1. An apparatus for manufacturing a continuous hinge comprising:

a. an elongated work support having input and output ends disposed to define a travel path and to support first and second moving adjacent strips (1, 1') on said travel path;

b. pay-off reel means for supplying first and second metal strips along said travel path for forming opposing leaves of a continuous hinge;

c. a press-machining station (10) including strip receiving roll means (28) for receiving and feeding each of the metal strips intermittently by a predetermined length, a pair of die means, each for simultaneously forming in each of the strips an outer side hole (2), notch (5) defining an inner flap (3) and a partially looped flap (7) by bending said flap (3) so that the notches and partially looped flaps in the first strip are offset from those for the second strip, each of said pair of die means including a punch (12) for forming the hole, a cutting block (11) for cutting the notch, a laterally slidable swaging die (17) biased away from the flap (3) defined by the notches and having an inwardly curved portion and a slant (20), an elevatable block having a curved projection (16) and a slant (19) for hitting and urging the swaging die towards the flap (3) by the slidable engagements of the slants (19) and (20) thereby forming the partially looped flap (7) by the press of the inwardly curved portion of the swaging die mating the curved projection of the elevatable block which is lowered, and means for lowering the punch, cutting block and elevatable block at the same time in a timed relation with the stoppage of each of the strips;

d. roller means (36) for bringing the partially looped flaps of the first strip into channel-like alignment with the adjacent partially looped flaps of the second strip;

e. guide roll means for guiding a wire pintle into a channel formed by aligned flaps of the first and second strips;

f. grooved rolls (38) to which said channel-like partially looped flaps with the wire pintle therein are directed, so as to constrict said partially looped flaps and close the loops over the wire pintle thereby forming a continuous hinge; and, g. a pair of laterally opposed squeeze rolls (39) having an annular depression (40) to complete the encircling of the wire serving as a pintle by the formed loops.

* * * * *